US005738510A

United States Patent [19]

McDonald

[11] Patent Number: 5,738,510

[45] Date of Patent: Apr. 14, 1998

[54] ROTARY KILN COOLER

[76] Inventor: Daniel McDonald, 110 Regent Avenue, Beaconsfield, Quebec, Canada, H9W-5A7

[21] Appl. No.: 748,418

[22] Filed: Nov. 13, 1996

[51] Int. Cl.[6] ..... F27D 15/02

[52] U.S. Cl. ..... 432/80; 432/77; 432/84

[58] Field of Search ..... 432/77, 78, 79, 432/80, 81, 82, 83, 84

[56] References Cited

U.S. PATENT DOCUMENTS 2,348,446 8/1943 Becker .
2,845,259 9/1955 Henrichsen .
3,809,528 5/1974 Kramm ..... 432/80
4,089,634 5/1978 Sylvest .
4,131,418 12/1978 Kramm et al. ..... 432/80

*Primary Examiner*—Henry A. Bennett
*Assistant Examiner*—Jiping Lu

[57] ABSTRACT

An annular cooler for a rotary kiln having a series of tubes longitudinally extending parallel to the axis of kiln and radially spaced therefrom. The tubes have flights mounted therein for carrying and moving clinkers discharged from the lower end of the kiln into the tubes and then upward to the upper end of the tubes where they are discharged into an appropriate collecting bin. A cooling medium is drawn downward through the tubes opposite to the direction of travel of the clinkers. The cooling medium which is heated as it travels through the tubes is directed into the kiln upon leaving the cooling tubes for use in the combustion process in the kiln.

6 Claims, 4 Drawing Sheets

ROTARY KILN COOLER

This invention relates to a rotary kiln for the production of cement clinkers and like materials. It is concerned more particularly with an incline rotary kiln having novel means mounted thereon for cooling the burned product and preheating air for use as a secondary air of combustion.

Annular coolers for rotary kilns are well known in the prior art as illustrated by U.S. Pat. No. 2,845,259 K. Henrichsen, U.S. Pat. No. 2,348,446 G. D. Becker and U.S. Pat. No. 4,089,634 Karl J. Sylvest. All of these patents teach rotary coolers for kilns having various means for propelling clinkers upward through tubes or conduits position along side the kiln to cool the clinkers.

The cooler of this invention is so constructed that the material being discharged from the kiln into the cooler is effectively cooled by being repeatedly lifted and shifted in a stream of cooling air as it moves through the cooling tubes.

The prior art annular coolers such as those shown in the above mentioned patents have difficulty moving the clinkers through the cooler tubes as the clinkers are being cooled.

The cooler comprises a chamber of annular cross sections formed by radially spaced inner and outer shrouds surrounding the kiln with the inner shroud attached to the kiln for rotating the cooler with the kiln. The chamber so formed is divided into a series of circumferencially spaced longitudinally extending cooler tubes by longitudinally extending spacer plates or dividers. The tubes are provided with a series of plate like elements mounted on the inner surface of one of its spacer plates or dividers and the outer shroud. As the kiln rotates these elements raise the burned material and propel it upward to the discharge end of the cooler. Air is drawn through the tubes in a direction opposite to the direction of travel of the burned material. As the material moves through the air stream it is cooled and the air is heated and directed into the kiln where it is available for use in the combustion process.

Therefore, it is the object of this invention to provide an improved rotary cooler and kiln arrangement.

Another object of this invention is to provide an improved rotary cooler and kiln arrangement which is efficient and which adequately cools the clinkers without introducing excess air into the kiln.

Still another object of this invention is to provide an improved arrangement for drawing air through the rotary type cooler in order to improve the efficiency of the cooler.

The invention accordingly, consists of a combination of elements and an arrangements of parts which is more fully set forth in the following detailed description in which.

Figure 1:
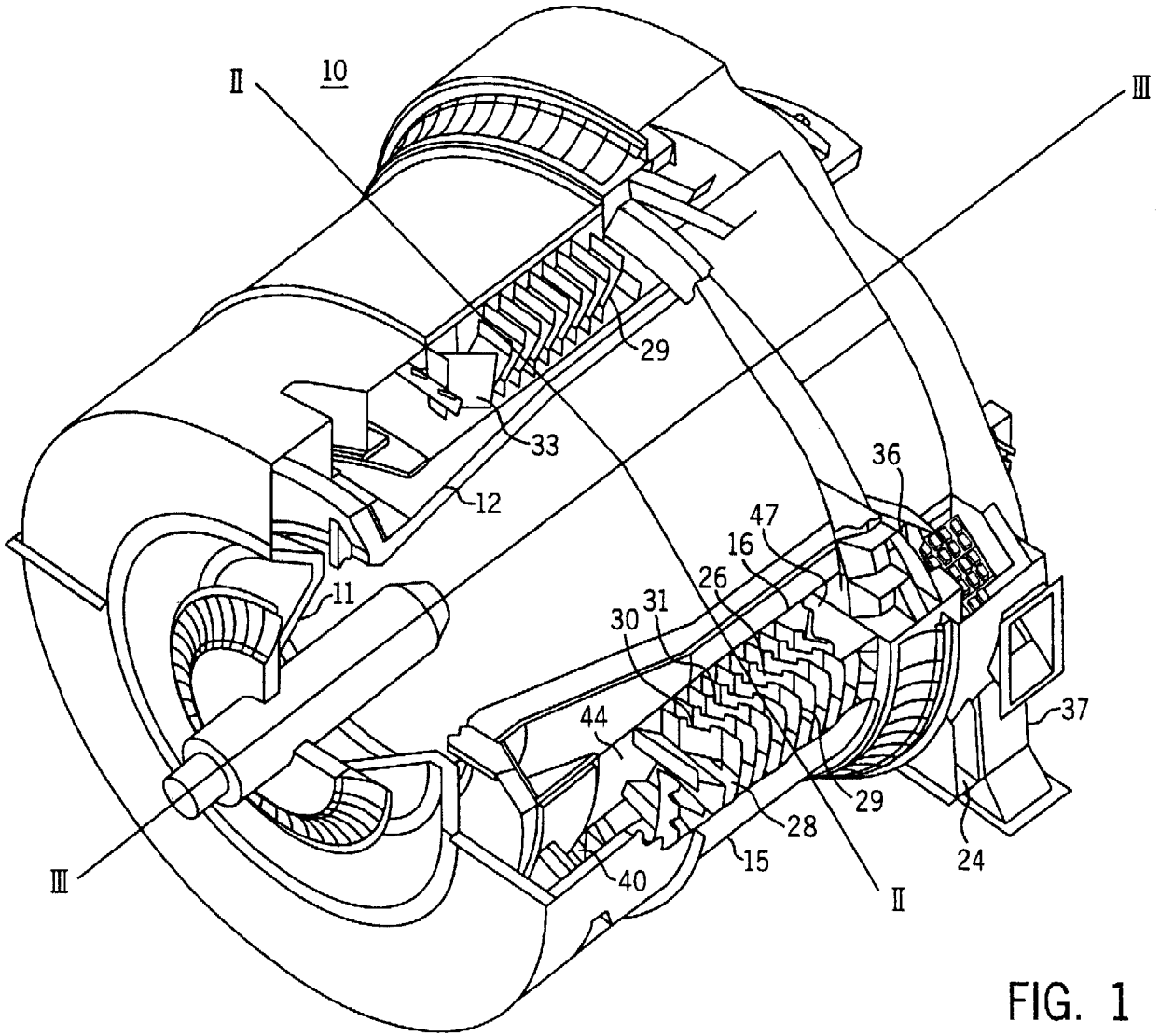
FIG. 1 is a detailed view partly in section of an inclined rotary cooler and kiln arrangement that illustrates the arrangement of the tubes and plates within the cooler tubes.
Figure 2:
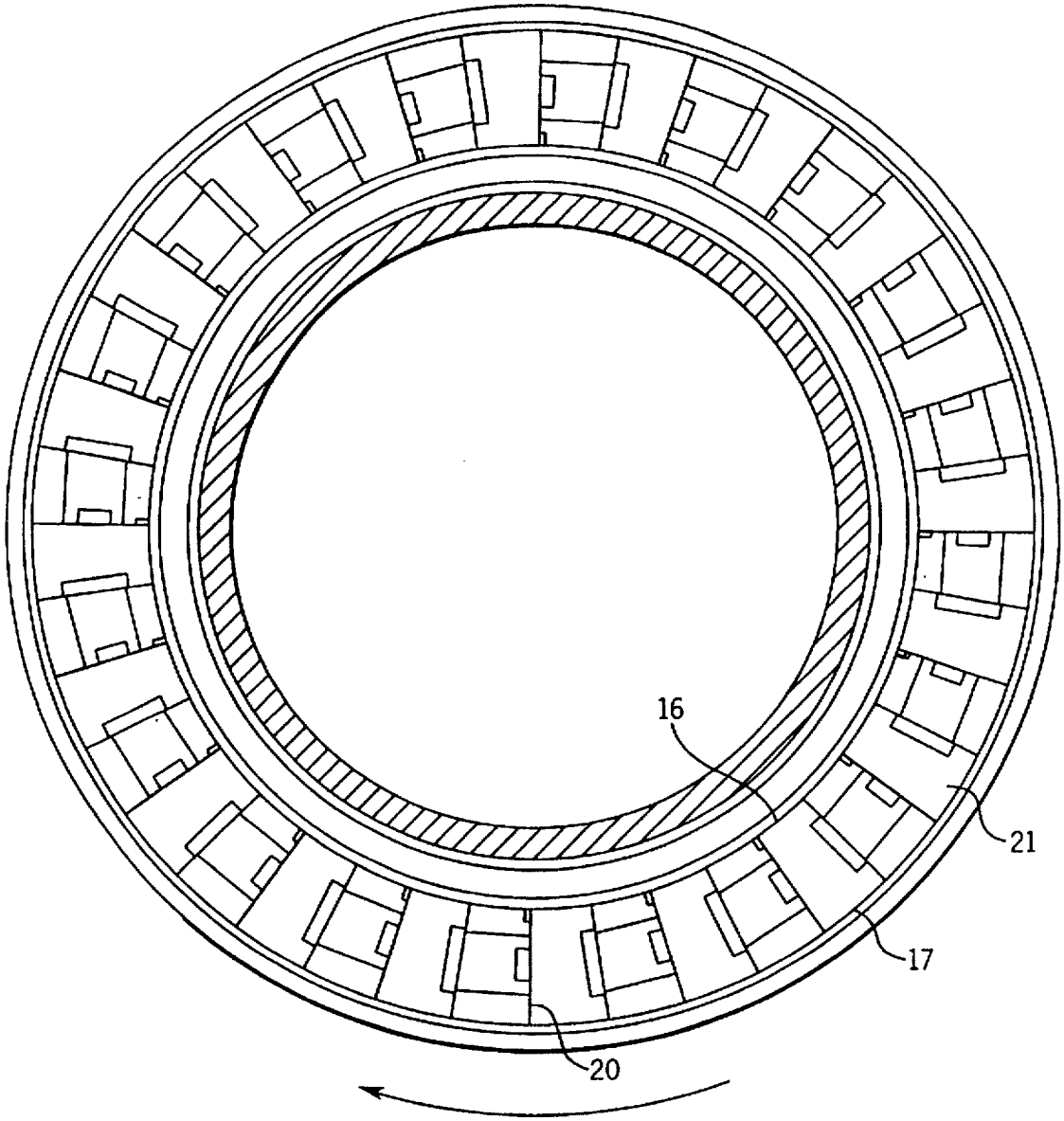
FIG. 2 is a cross-section view taken along the line II—II of FIG. 1 showing the loading of clinkers in the compartments at the cooling tubes.
Figure 3:
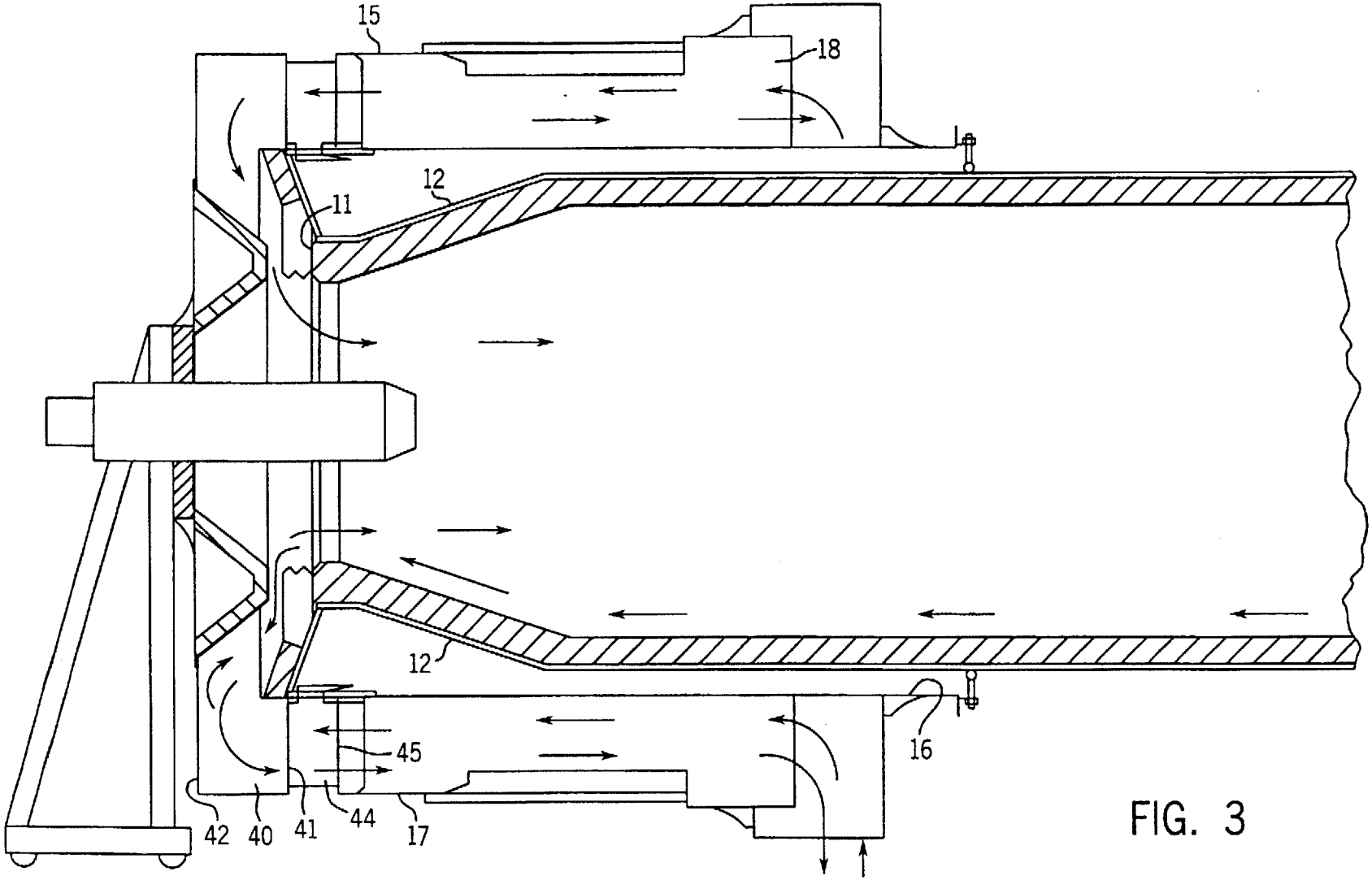
FIG. 3 is a cross-section view taken along the line III—III of FIG. 1 showing the flow pattern of the clinkers and cooling gas through the cooler tubes and the kiln.

The invention is illustrated in combination with a conventional inclined rotary kiln 10 for processing material such as iron ore delivered into the upper end of the kiln. An annular opening or trough 11 is formed near the discharge or lower end of the kiln shell 12.

The cooler 15 consists of a pair of longitudinally extending radially spaced cylindrical shroud members 16, 17 surrounding the kiln 10 to form an annular space 18 there between. The inner shroud member 16 is radially spaced from but mounted on the outer surface of the kiln shell 12 for rotations therewith. A series of circumferentially spaced longitudinally extending dividers or spacer walls 20 are mounted between the cylindrical shroud members 16, 17 to form a series of longitudinally extending cooling tubes 21. The lower end of the tubes 21 have openings that communicate with the opening 11 in the lower end of the kiln shell 12 to receive hot clinkers from the kiln as it rotates. A source 24 of cooling gas such as air is provided near the upper end of the cooler tubes 21 to enable gas to be drawn downwardly through the cooling tubes 21 counter to the direction of the travel of the clinkers through the tubes to cool the clinkers. The air is heated as it passes through the tubes 21 and past the hot clinkers and is then discharged from the tubes into the kiln for use in the combustion process. The interior of the kiln is at less than atmospheric pressure and provides a natural draw of the air from the source through the tubes to the interior of kiln.

Figure 4:
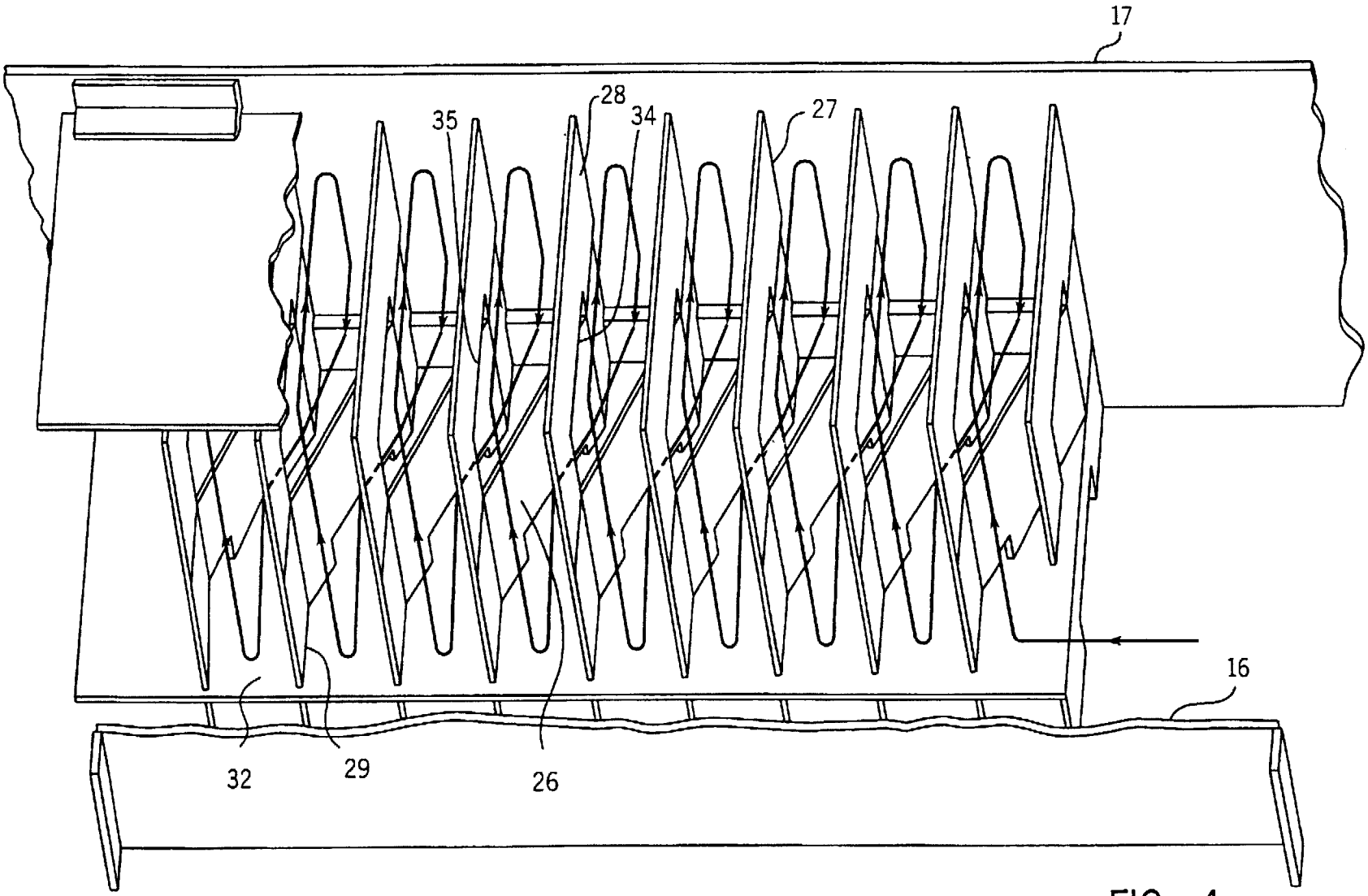
FIG. 4 is an enlarged view showing the flow pattern of the clinkers through the flights within a tube.

A series of plates or flights 27 are selectively mounted within the cooler tubes to convey the clinkers in an upward direction as the kiln and cooler rotate. The key to moving the clinkers upwardly through the downwardly inclined tubes is the placement and configuration of the plates or flights within the tube as shown in FIGS. 1 and 4. A first set of longitudinally spaced flat flights called neutral flights 28, are welded to one of the dividers 20 and extend partially across the tube. The function of the neutral flight 28 is to tumble the clinkers to expose them to the cooling gas but prevent most of them from falling back into a upward sector 32 formed between the flights.

A second set of flights are called propeller flights 29 are mounted on the other of the dividing walls that form the tube and extend initially at right angles to the divider walls, then at an angle upward relative to the divider wall. The propeller flight then extend in a direction that is at a right angle relative to the dividing walls and aligned with the next neutral flight. The angle at which the propeller flights extend depends on the spacing between flights but is approximately 30 degrees in the preferred embodiment.

The shrouds 16, 17, the dividers 20 and the adjacent flights combine to form there between a series of axially spaced sectors 32. A set of inlet flights 33 may be provided ahead of the first of the neutral flights to aid in moving the clinkers from the second compartment into the first of the sectors. The propeller flights 29 at each end of the tubes have an opening 30 near the shroud 17 adjacent to the kiln shell and the divider 20 to allow some of the clinkers at the lower end of the flight to fall backwards into a lower sector 32 or compartment while the inclined portion of the flight 29 propels the other clinkers upward along the tube 21 into the next upward sector 32. The remainder of the propeller flights 29 have an opening 31 generally centered on the inner edge of the angled portion 26 of the propeller flights to allow some clinkers to fall backward while the others are propelled upward. Each neutral flight 28 has an opening 34 in its inner edge 35 to allow some of the clinkers to fall backward through the opening. In the preferred embodiment the opening in the neutral flight is near the center of the flight.

The upper end of the cooler tubes 21 have openings 36 in the outer shroud 17 that communicate with a chute 37 at the top of the cooler which in turn conveys the cooled clinker into a bin for further treatment.

In operation, clinkers are delivered into the kiln where they flow downward through the kiln as they are being heat-treated. When the clinkers reach the lower end of the kiln they fall through the opening 11 in the shell 12 into a first compartment 40 formed by the shrouds a dam member 41, and an end cap 42, attached to the lower ends of the shrouds 16, 17, and the shell 12. As the clinkers fill the first compartment 40 they spill over into a second compartment 44 formed by the shrouds, a second dam member 45 and the inlet flights 33 adjacent to the first of the neutral flight 28. The clinkers are then propelled upward through the tubes 21 by the propeller flights 29 until they reach the top portion of the tubes 21 where they enter a third compartment 47 and fall through the openings 36 in the tubes 21 into chute 37 from where they are delivered to a storage bin for further treatment.

Although the invention has been described in connection with a specific inclined rotary kiln-cooler it will be obvious to those skilled in the art that various changes and modifications can be made within the spirit of the invention.

The embodiments of the invention in which an exclusive property or privilege is claimed are defined as follows:

1. An annular cooler in combination with an inclined rotary kiln for processing material comprising:

A kiln having a cylindrical shell having an opening adjacent its lower end, a pair of radially spaced cylindrical shrouds surrounding said shell, the radial inner shroud being attached to said shell, a series of longitudinally extending spacer plates arcuately spaced between said shrouds to form a series of longitudinally extending cooling tubes, the lower end of said radially inner shroud having an opening in communication with said opening in said kiln shell for receiving hot clinkers into said cooler, each said tube having a series of longitudinally spaced neutral flights connected to one of said spacer plates and extending into the tube at a right angle to said tube axis, each said tube having a series of longitudinally spaced propeller flights connected to the other of said spacer plates and extending initially directly toward an opposing neutral flights and then at an angle upward relative to said neutral flight and then directly at the next neutral flight to propel some of said clinkers upward through said tubes, said spacer plates, said shrouds and said flights combining to form a series of adjacent sectors, said propeller flights having an opening at its inner edge to allow some of said clinkers to drop back into the adjacent lower sector, each of said neutral flights having an opening in its inner edge to allow some of the clinker to pass downward into the next lower sector, means connected to the upper ends at said tubes to enable a cooling medium to flow downward through said cooling tubes and then into the interior at said kiln for use in the combustion process within said kiln said shell having an opening near its upper end to discharge said clinkers each of said tubes having an opening in said outer shroud at its upper end in communication with said opening in said shell through which clinkers can be discharged; and mean for collecting said clinkers as they are discharged.

2. The combination of claim 1 in which said opening in said propeller flight is in the angled portion.

3. The combination of claim 1 in which said opening in said neutral flights is near the center of its inner edge.

4. The combination of claim 1 having an inlet flight positioned immediately ahead of the first of said neutral flights.

5. The combination of claim 1 in which said angled portion of said impeller flight extends upward at an angle of approximate 30° relative to said spacer plates.

6. The combination of claim 1 in which said inner shroud is radially spaced from said shell.

* * * * *